US006168139B1

(12) United States Patent
Kennedy et al.

(10) Patent No.: US 6,168,139 B1
(45) Date of Patent: Jan. 2, 2001

(54) AIR FLOW ACTIVATED CONTROL UNIT FOR A FURNACE

(76) Inventors: Joseph A. Kennedy; Gerri M. Condo, both of 110 Glidden Road, Brampton, Ontario (CA), L6T 2J3

( * ) Notice: Under 35 U.S.C. 154(b), the term of this patent shall be extended for 0 days.

(21) Appl. No.: 09/272,369

(22) Filed: Mar. 19, 1999

(30) Foreign Application Priority Data

Feb. 5, 1999 (CA) ..... 2261325

(51) Int. Cl.[7] ..... B01F 3/04

(52) U.S. Cl. ..... 261/26; 261/69.1; 261/107; 261/DIG. 15; 261/DIG. 34; 261/DIG. 41

(58) Field of Search ..... 261/66, 69.1, 100, 261/106, 107, DIG. 4, DIG. 15, DIG. 34, DIG. 41, 26

(56) References Cited

U.S. PATENT DOCUMENTS

| | | | | |
|---|---|---|---|---|
| 3,038,708 | * | 6/1962 | Rice | 261/66 |
| 3,902,473 | | 9/1975 | Yeagle . | |
| 4,029,723 | | 6/1977 | Morrison et al. . | |
| 4,211,735 | | 7/1980 | Berlin . | |
| 4,222,971 | | 9/1980 | Eilert . | |
| 4,237,080 | | 12/1980 | Elliott . | |
| 4,738,805 | | 4/1988 | Lawson . | |
| 5,397,510 | | 3/1995 | Clark . | |
| 5,765,544 | | 6/1998 | Vigansky, Jr. . | |

FOREIGN PATENT DOCUMENTS

| | | | | |
|---|---|---|---|---|
| 6-147572 | * | 5/1994 | (JP) | 261/107 |

* cited by examiner

*Primary Examiner*—David A. Simmons
*Assistant Examiner*—Robert A. Hopkins
(74) *Attorney, Agent, or Firm*—Eugene J. A. Gierczak

(57) ABSTRACT

An air flow activated humidifier for use in a ventilation system comprising a water evaporating means, displacing means engageable by the air flow of said ventilation system for displacing said water evaporating means, and activating means operably associated with said displacing means for activating said humidifier when said water evaporating means is displaced. A control system for a flow-through humidifier comprising a pivoting means, returning means, switching means and water valve. A method for humidifying circulated air using an air flow activated humidifier.

22 Claims, 8 Drawing Sheets

AIR FLOW ACTIVATED CONTROL UNIT FOR A FURNACE

FIELD OF INVENTION

This invention relates generally to an improved furnace humidifier for use in association with a forced air furnace. This invention further relates to a control system for controlling a furnace humidifier. This invention still further relates to a method for humidifying air heated by a forced air furnace.

BACKGROUND OF INVENTION

This invention relates to the art of humidifying air circulated by ventilation systems, including heating systems using air heated by a forced air furnace. More particularly, the invention relates to an improved furnace humidifier that is mounted on a forced air furnace, a control system for controlling such furnace humidifier, as well as a method for humidifying air heated by a forced air furnace.

Furnace humidifiers of various types are well-known. One type of evaporative humidifier uses a drum or disk component which is partially submerged in a reservoir of water, is rotated while forced air or a convection current of air from a furnace moves through the component. Other furnace humidifiers use a stationary plate or rotating brush to conduct moisture into the path of an air flow. In all of such humidifiers, a float valve usually adds water to the reservoir as evaporation occurs, to maintain a constant or predetermined water level in the reservoir.

There are numerous disadvantages to the prior art drum or disk type humidifiers. For example, furnace humidifiers of this type are generally complicated and therefore expensive to produce. Not only is a reservoir required, but also a float valve, as well as a motor to sustain the rotation of the drum or disk.

Various control systems for use in operation with furnace humidifiers of this first type are also known. For example, U.S. Pat. No. 5,397,510 issued on Mar. 14, 1995 to Clark relates to a control system which will reliably signal and/or deactivate upon depletion of the water supply thereto. A further object of this invention is to provide a humidifier with the water container supported by a biasing spring, but with the spring having a non-linear increasing force to ensure operation of the switching system.

A second type of evaporative humidifier of relatively more simple construction does not utilize a reservoir but rather employs an evaporation pad through which water is allowed to flow to a drain pipe.

The prior art evaporative humidifiers of both the first and second type described above generally require complicated electric means for activating and de-activating the furnace humidifiers so that the furnace humidifier is only active when the forced air furnace is also in operation, to avoid energy waste and extend the lifetime of the furnace humidifier. The need for such complicated electric means increases the complexity and therefore cost of production of such prior art furnace humidifiers. In addition, in the case of many such evaporative humidifiers, the humidifier unit must be connected to the furnace's internal or control wiring, therefore installation of such furnace humidifiers is relatively difficult.

There is a need therefore for a furnace humidifier of simple construction that is easy and inexpensive to produce, and which can be installed without difficulty.

SUMMARY OF THE INVENTION

In accordance with yet another aspect of the invention, an air flow activated humidifier for use in a ventilation system comprising a water evaporating means; displacing means engageable by the air flow of said ventilation system for displacing said water evaporating means; and activating means operably associated with said displacing means for activating said humidifier when said water evaporating means is displaced.

In accordance with still another aspect of the invention, a humidifier for use in a ventilation system comprising: a casing associated with at least one air duct of said ventilation system; water evaporating means associated with a water source; displacing means for mounting said water evaporating means within said casing whereby air flow of said air duct displaces said water evaporating means from a first resting position to a second displaced position; and activating means operably associated with said displacing means for activating said water evaporating means when said water evaporating means is in said second displaced position.

In accordance with a further aspect of the invention, a humidifier for use in association with a forced air furnace having a supply air duct and return air duct, each of said supply air duct and return air duct having a duct opening: a casing having a first opening for communicating with one of said supply air duct or return air duct and second opening for communicating with said other one of said supply air duct or return air duct; connecting means for connecting said first opening to said duct opening and said second opening to said duct opening to establish said communication between said casing, supply air duct and return air duct; water evaporating means associated with a water source; means to regulate flow of water from said water source to said water evaporating means; switching means for activating said regulating means; displacing means for mounting said water evaporating means within said casing whereby air flow within said air ducts displaces said water evaporating means from a first resting position to a second displaced position; and means for returning said water evaporating means from said second displaced position to said first resting position upon reduction of said air flow in said air ducts; wherein said displacing means and switching means are operably associated to engage said humidifier by activating said regulating means when said forced air furnace generates said air flow.

In accordance with a still further aspect of the invention, a control system for a flow-through humidifier associated with the supply and return air ducts of a forced air furnace, said flow-through humidifier comprising a casing and porous evaporation pad mounted within said casing, said porous evaporation pad being associated with a water source, wherein said casing can be mounted on either of said supply or return air ducts, said control system comprising: a pivoting means for pivoting said porous evaporation ad from a first resting position to a second displaced position upon air flow in said ducts on which said casing is mounted; means for returning said porous evaporation pad from said second displaced position to said first resting position when there is no air flow in said ducts; switching means connected to a power source and operably associated with said pivoting means when said porous evaporation pad is in said second displaced position; and water valve engageable by said switching means to regulate flow of water from said water source to said porous evaporation pad.

In accordance with a still further aspect of the invention, a method for humidifying air circulated by a forced air furnace, said furnace having a supply air duct and return air duct, comprising the steps of: creating openings on said supply air duct and return air duct; mounting on either of said supply air duct or return air duct a casing having a first opening for communicating with said supply air duct and second opening for communicating with said return air duct, said casing further including: valve associated with a water source, displacing means, switching means operably associated with said valve and said displacing means for activating said valve and returning means; connecting said first opening to said supply air duct and said second opening to said return air duct to establish communication between said casing, supply air duct and return air duct; mounting a flow-through evaporation pad within said casing, said displacing means being engageable by air flow present in either of said supply air duct or return air duct on which said casing is mounted to displace said flow-through evaporation pad from a first resting position to a second displaced position; and connecting said casing to a power source whereby said valve is activated when said flow-through evaporation pad is in said second displaced position and said switching means is thereby engaged.

BRIEF DESCRIPTION OF DRAWINGS

A detailed description of the preferred embodiments are provided herein below, by way of example only, with reference to the following drawings, in which.

Figure 1:
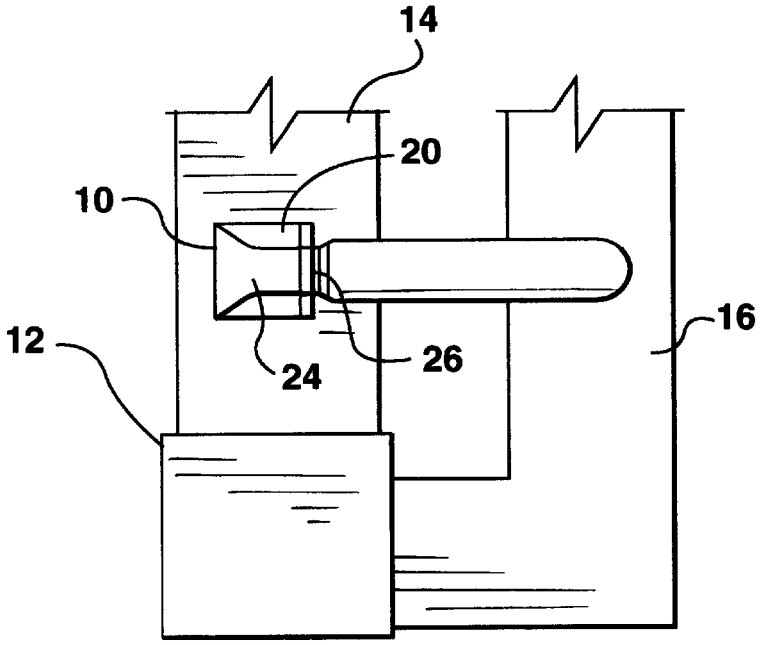
FIG. 1 is a front view of the invention, as mounted on a furnace.

In the drawings, preferred embodiments of the invention are illustrated by way of example. It is expressly understood that the description and the drawings are only for the purpose of illustration and as an aid to understanding and are not intended as a definition of the limits of the invention.

BEST MODE FOR CARRYING OUT THE INVENTION

In the description which follows, like parts are marked throughout the specification and the drawings with the same respective reference numerals. The drawings are not necessarily to scale and in some instances proportions may have been exaggerated in order to more clearly depict certain features of the invention.

Referring to FIG. 1, there is illustrated a preferred embodiment of the furnace humidifier 10 mounted for operation with furnace 12. Furnace 12 comprises a supply air duct (warm air) 14 and return air duct (cold) 16. In the mode of operation illustrated herein, a hole such as aperture (not shown) is cut on each of said supply air duct 14 and return air duct 16. Furnace humidifier comprises a casing 20. Said casing 20 further comprises a base 22 (shown in FIG. 2), cover 24 and first side opening 26.

Figure 2:
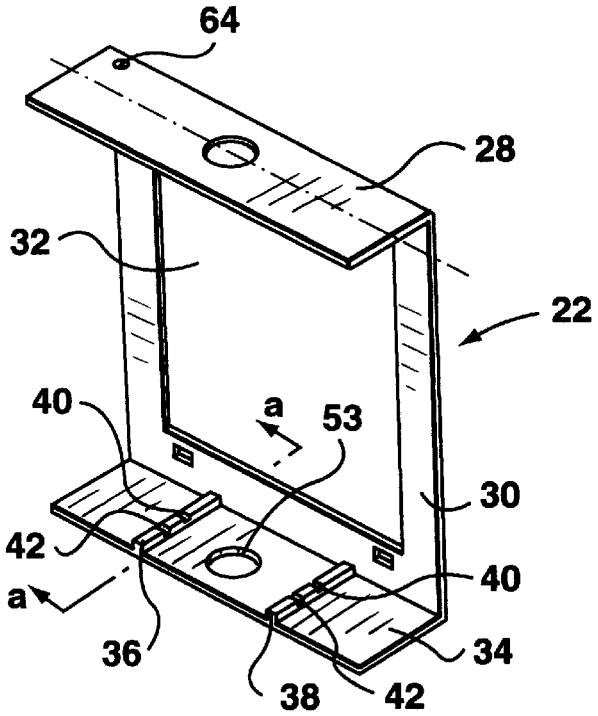
FIG. 2 is a perspective view of the base of the invention.
Figure 3:
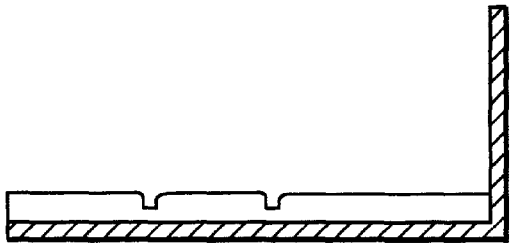
FIG. 3 is a cross-sectional view of the base of the invention along line a—a.

As best shown in FIG. 2, said base 22 comprises a top wall 28, back wall 30, duct aperture 32 disposed within said back wall 30, and bottom wall 34. Said base 22 is mounted to either of said supply air duct 14 or return air duct 16 by means of fastening means such as screws or the like, whereby duct aperture 32 communicates with either of said supply air duct 14 or return air duct 16. First side opening 26 is then connected to the other of said supply air duct 14 or return air duct 16 by means of ordinary air duct tubing, thereby allowing air to flow through casing 20 from the high pressure supply air duct 14 to the low pressure return air duct 16.

The preferred embodiment of the invention disclosed herein is designed to operate on either a supply air duct or return air duct, whichever may be the most accessible, for example. However, installation on a return air duct is recommended because of the risk of water spillage from the furnace humidifier into the furnace body and electric components contained therein where casing 20 is installed on a supply air duct. Because the probable consequences of such spillage depend on the design of the specific furnace, some users may decide to install the furnace humidifier disclosed herein on a supply air duct, hence the benefit of one furnace humidifier which may be mounted on either of said ducts. The invention herein, however, extends to both modes of installation.

Figure 10:
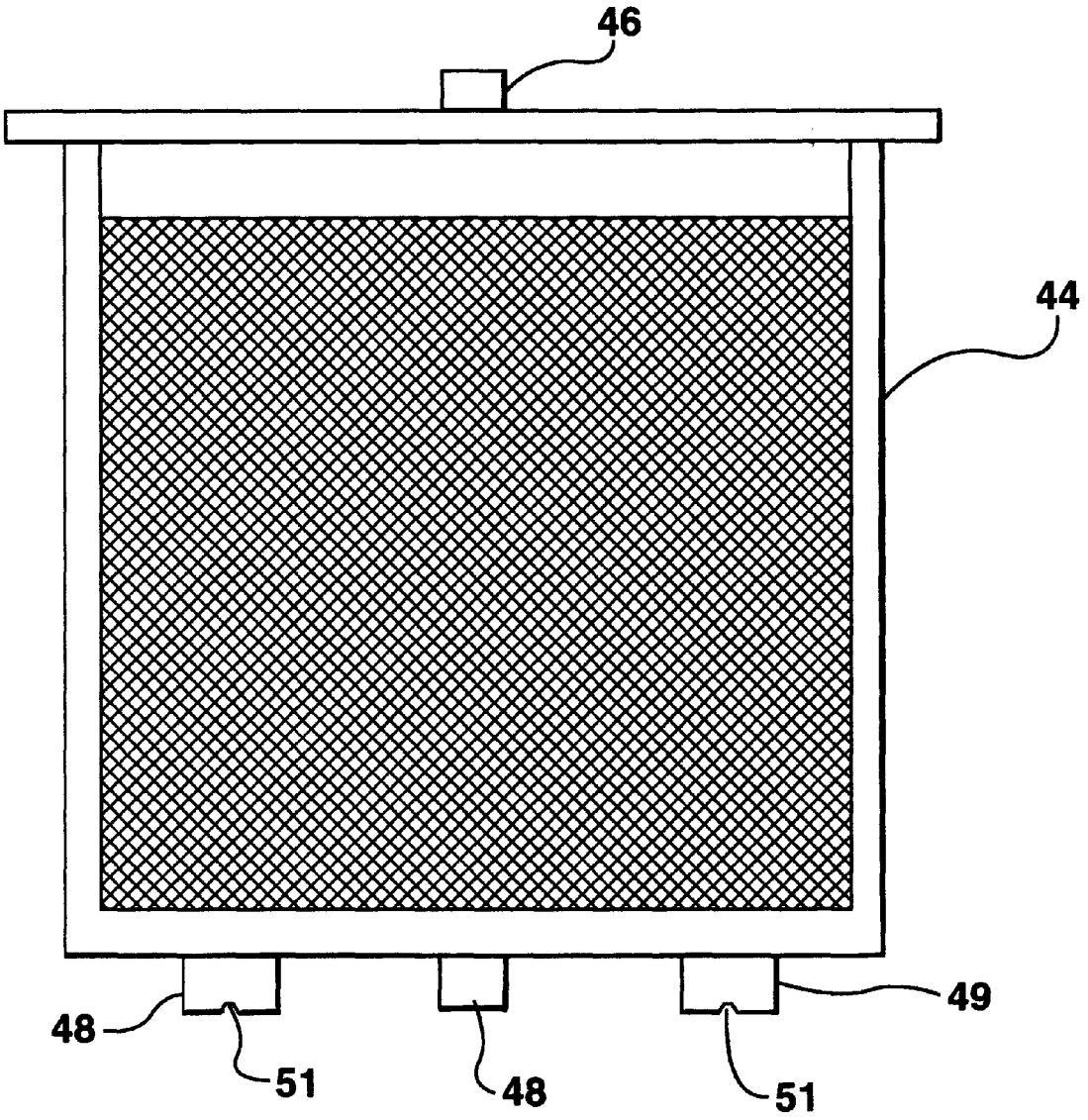
FIG. 10 is a front view of the evaporation pad.

Also as seen in FIG. 2, the bottom wall 34 further comprises two parallel lateral protrusions 36, 38, each of which lateral protrusions comprises a first pair of pivoting channels 40 and second pair of pivoting channels 42. The preferred embodiment of the invention disclosed herein utilizes a standard flow-through evaporation pad 44 comprised of porous synthetic material commonly used in humidifiers of all types. As shown in FIG. 10, said evaporation pad includes a top opening 46 for communicating with a water pipe and bottom opening 48 for communicating with a drain pipe. In operation, water enters the evaporation pad 44 and flows through and disperses within the porous fibres comprising the evaporation pad 44 and then flow out of bottom spout 48 and casing drain 53 (shown in FIG. 2).

Figure 7:
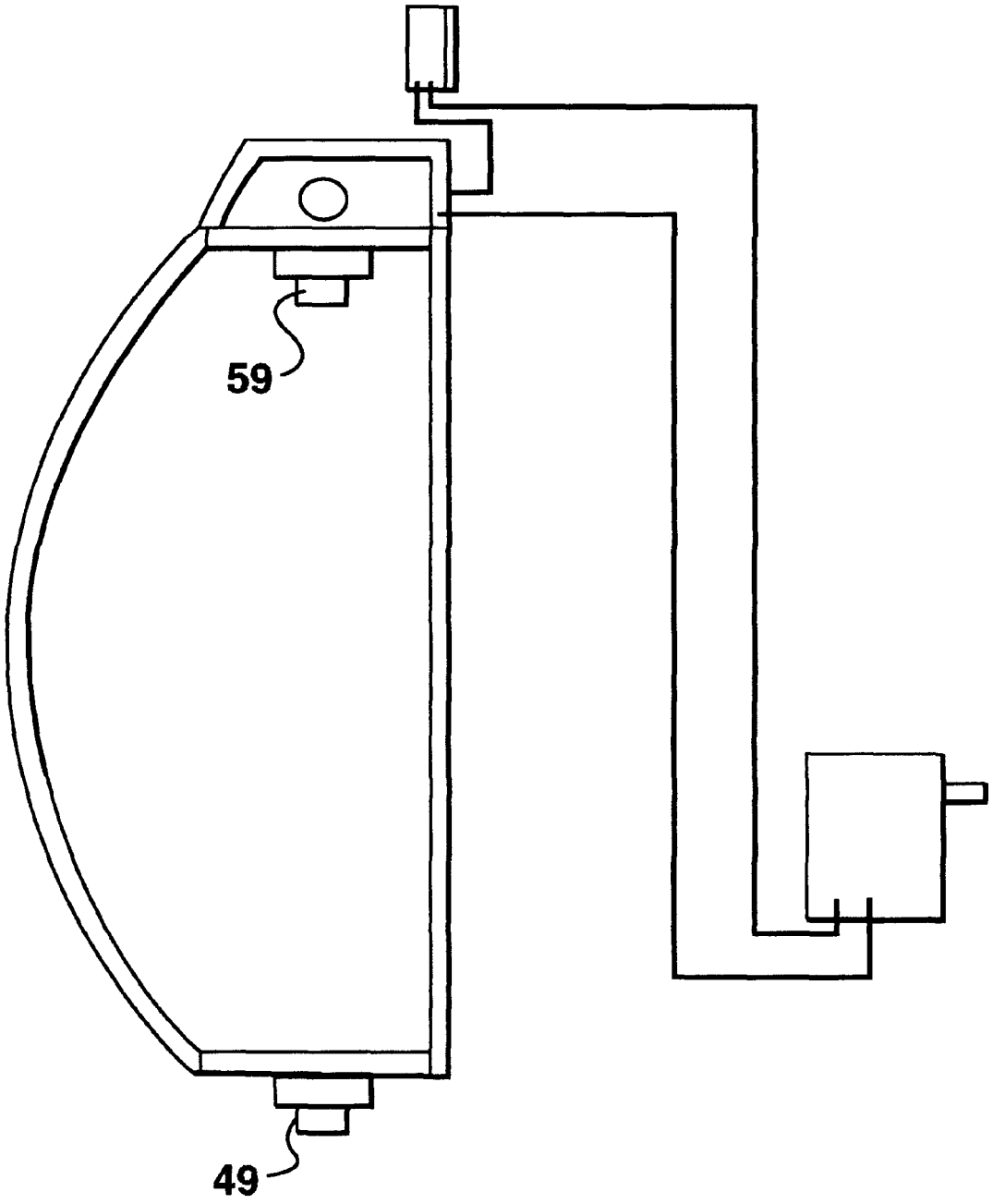
FIG. 7 is a side perspective view of the intention.
Figure 8:
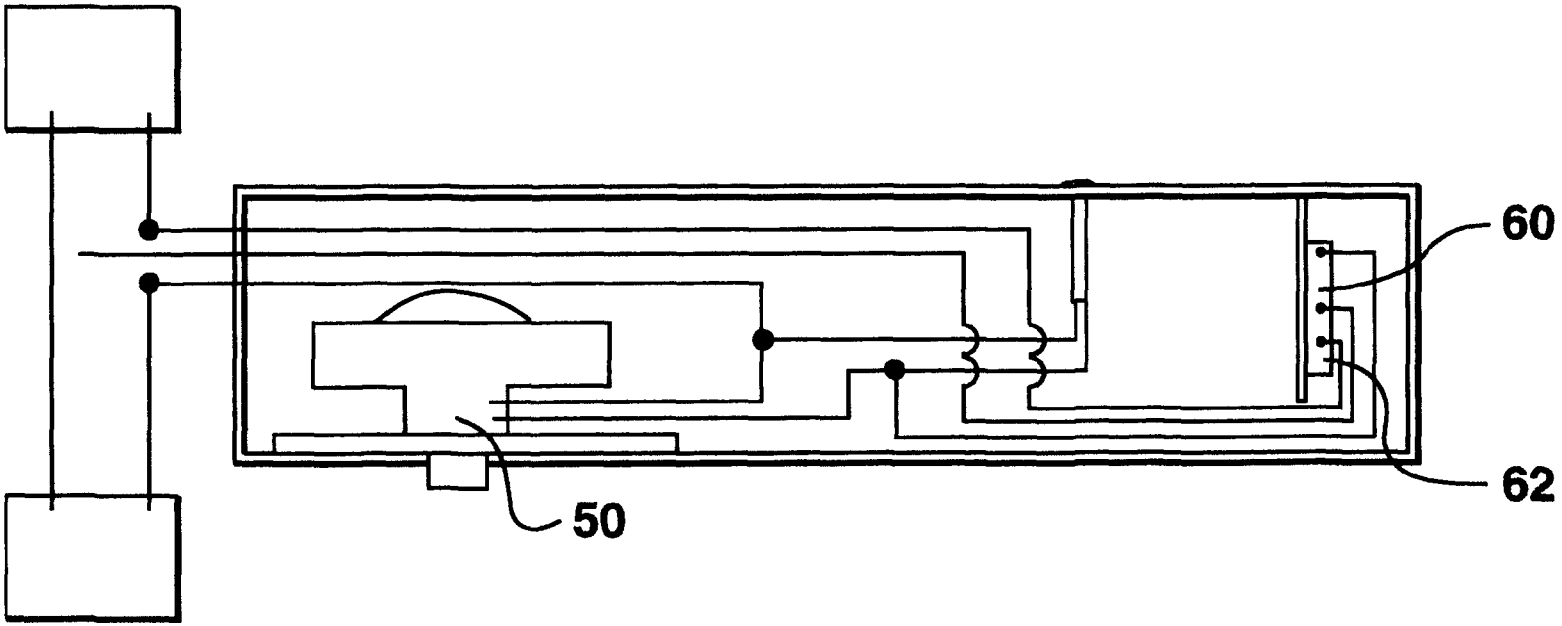
FIG. 8 elevated view of the control system of the invention.

As best shown in FIG. 8, the embodiment of the present invention contains a water valve 50 which presents means for connecting said water valve 50 to a water source, such as a water pipe connected to an ordinary interior water piping system, in a manner well-known to those skilled in the art. Water valve 50 further communicates with tubing which in turn is received by water inlet aperture 56, as shown in FIG. 2, disposed in top wall 28, said tubing being connected to water spout 59 which provides water to said evaporation pad, as best shown in FIG. 7.

Said evaporation pad 44 further includes pivoting ridges or legs 54 which are off centre to facilitate pivoting, as best shown in FIGS. 4*a*, 4*b*, 5*a*, 5*b*. Said pivoting ridges 54 may be moulded as part of the frame of said evaporating pad 44, or may be made of plastic or metal, and affixed to said evaporation pad using, for example, an adhesive. Said pivoting ridges 54 communicate with said pairs of pivoting channels 40, 42. Because said pairs of pivoting channels are marginally larger than pivoting ridges 54, said pivoting ridges 54 do not interlock with said pivoting channels 40, 42 but rather pivot in said pivoting channels 40, 42. Bottom spout 48, which is received by casing drain 53 also further assists in minimizing the chance of lateral displacement of the evaporating pad 44.

The bottom edge of said pivoting ridges 54 could be straight so as to fit within said pivoting channels 40, 42, or as shown in FIG. 10, the bottom edge 49 of said pivoting ridges 54 could further include a notch 51 so as to straddle said lateral protrusions 36, 38 within said notches 51 thereby minimizing the chance of lateral displacement of said evaporation pad 44.

Figure 4A:
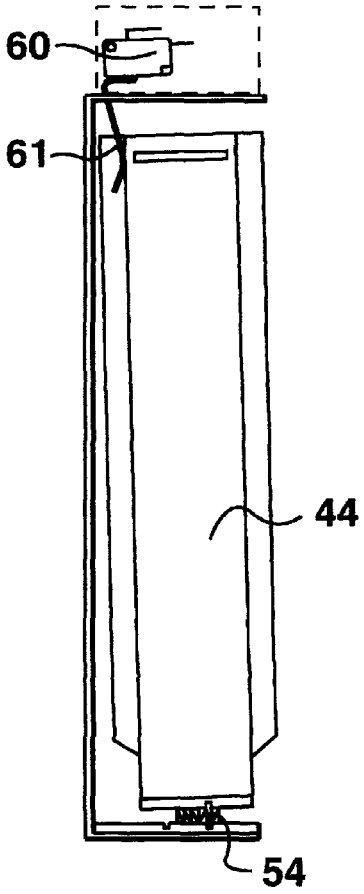
FIG. 4*a* is a cross-sectional view of the invention mounted on a return duct in the "off" position.
Figure 4B:
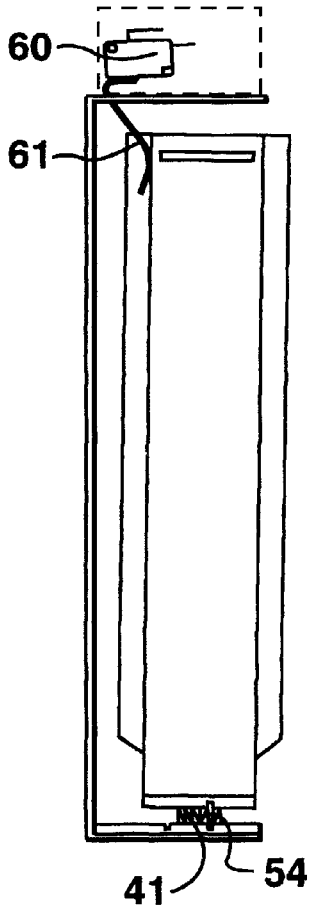
FIG. 4*b* is a cross-sectional view of the invention mounted on a return duct in the "on" position.

In the preferred embodiment shown in FIGS. 4*a*, 4*b*, a foam pad 41 could assist in stabilizing the rocking motion of the evaporation pad 44. Alternatively, a stabilizing shoulder 43 can be used as shown in FIG. 5*c*. The invention described herein also extends to an embodiment where the pivoting channels 40, 42 are presented in the evaporating pad 44 assembly and said pivoting ridges are presented by casing 20.

In order to install said evaporation pad 44, as disclosed in the preferred embodiment of the invention described herein, said pivoting ridges 54 are placed in either of said pivoting channels 40, 42 within said casing 20. Said top opening 46 of the evaporation pad is connected by means of tubing to water spout 59. Sufficient tubing is used so as not to impede movement of the evaporation pad 44 within casing 20. Further tubing is passed through casing bottom aperture 53 and then to a water drain to drain water that has flowed through evaporation pad 44.

Figure 9:
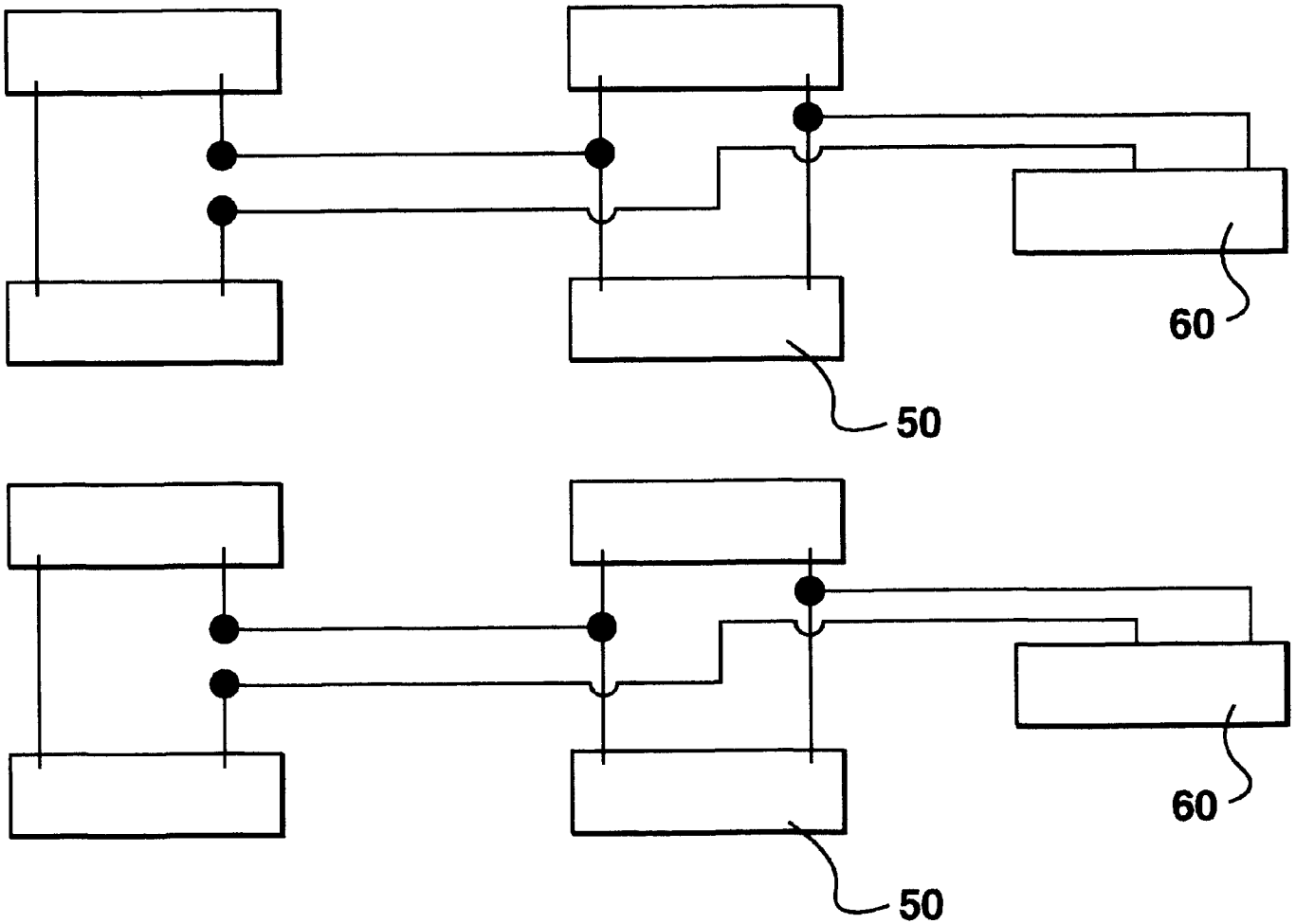
FIG. 9 is a circuit diagram of the control system of the invention.

As best shown in FIG. 8, the invention described herein further includes a switching means 60, which as shown in FIG. 9 is electrically connected to water valve 50. Switching means 60, which is also seen in FIGS. 4*a*, 4*b*, 5*a*, 5*b* is a standard limit switch with a contact arm 61. Switching means 60 is further connected to selecting switch 62 (as shown in FIG. 8) which allows selection of whether a circuit is closed when contact arm 61 is depressed or when contact arm 61 is not depressed.

Water valve 50 is a standard solenoid valve. The control circuit of the invention described herein, as best shown in FIG. 9, utilizes a 24V current which is supplied by means of electric wiring and a transformer, which transformer is connected to a standard 110V electric plug.

Now referring to FIGS. 4*a*, 4*b*, 5*a*, 5*b*, various cross-sectional views of the evaporation pad 44 are shown, as installed within casing 20 by means of either of said pairs of pivoting channels 40, 42 and pivoting ridges 54. Said switching means 60, as discussed above, comprises contact arm 61 which communicates with the interior of casing 20 occupied by evaporation pad 44 by means of contact arm aperture 64, as best seen in FIG. 2.

As best shown in FIG. 5*c*, the preferred embodiment of the invention described herein further comprises a stabilizing shoulder 43 adjacent to said pivoting ridges 54. Said pivoting channels, 40, 42, pivoting ridges 54 and stabilizing shoulder 43 in cooperation with said evaporation pad 44 ensure that the evaporation pad 44 is balanced within said casing 20 when in the first resting position.

Now referring to FIG. 4*a*, evaporation pad 44 is shown in operation as mounted to the return air duct of a furnace, in which case said selecting switch 62 is in the "RETURN" position, in which case contact arm 61 closes a circuit connection when it is engaged; and said pivoting ridges 54 are placed in said first pair of pivoting channels 40. In FIG. 4*a* evaporation pad 44 is in the first resting position in which contact arm 62 is not engaged.

Now referring to FIG. 4*b*, evaporation pad 44 is also shown in operation as mounted to the return air duct of a furnace, but now in a second displaced position. When the furnace is in operation and air is drawn in for heating through the return air duct, the pressure is lower inside the return air duct than outside. Consequently, as shown in FIG. 4*b*, when the furnace is in operation air flows from the higher pressure supply air duct, through casing 20 so as to force evaporation pad 44 toward duct aperture 32, whereby pivoting ridges 54 pivot within said first pair of pivoting channels 40, whereby said evaporation pad 44 pivots to said second displaced position. Also as shown in FIG. 4*b*, said evaporation pad 44 comes into contact with contact arm 61 thereby engaging said water valve 50. Said water valve 50 thereby opens the flow of water to evaporation pad 44 consequently bringing the furnace humidifier into operation.

When the furnace is deactivated, and thereby the flow of air is reduced in said return duct, the pressure within the return duct returns to normal and gravity causes the evaporation pad 44 to pivot to the first resting position, shown in FIG. 4*a*. Contact with contact arm 61 thereby ceases, thus deactivating water valve 50 and consequently closing the water flow to the evaporation pad 44. The furnace humidifier is thereby shut off.

Figure 5A:
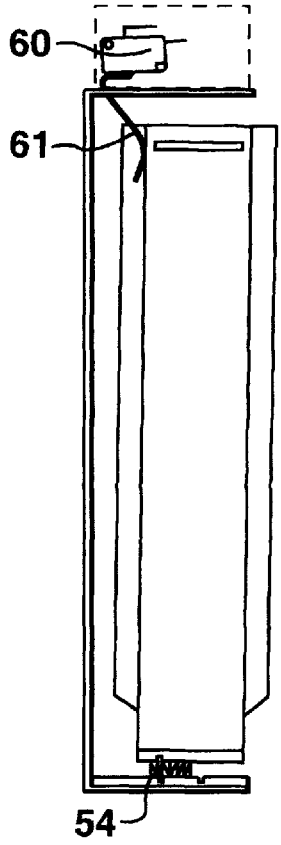
FIG. 5*a* is a cross-sectional view of the invention mounted on a supply duct in the "off" position.
Figure 5B:
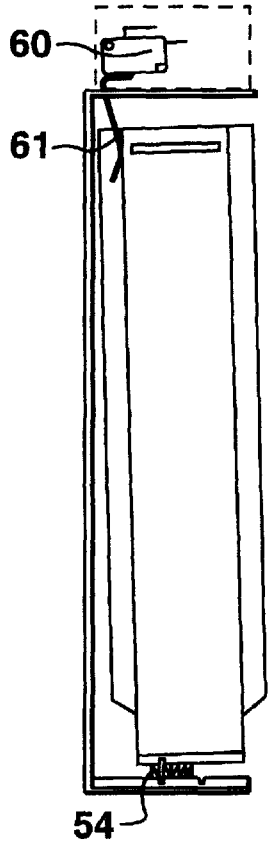
FIG. 5*b* is a cross-sectional view of the invention mounted on a supply duct in the "on" position.
Figure 5C:
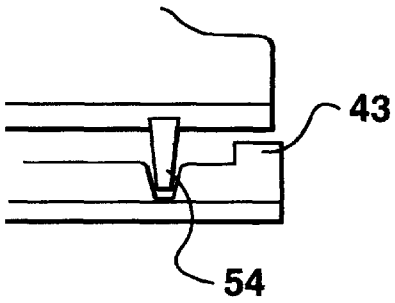
FIG. 5*c* is a further cross-sectional view of the invention showing an alternate embodiment having a stabillizing shoulder.
Figure 6A:
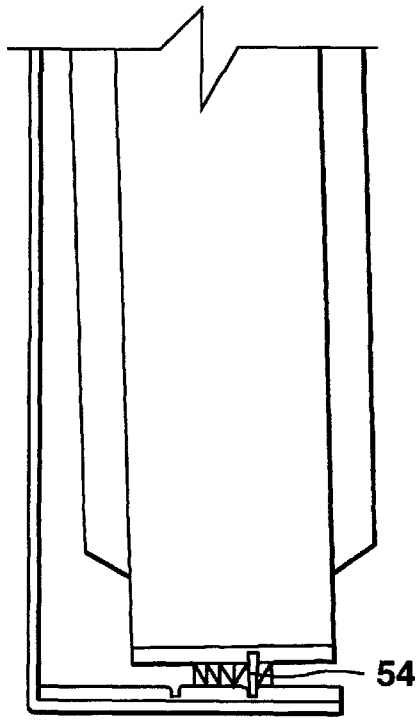
FIG. 6*a* is an enlarged cross-sectional view of the pivoting means of the invention in the first resting position.
Figure 6B:
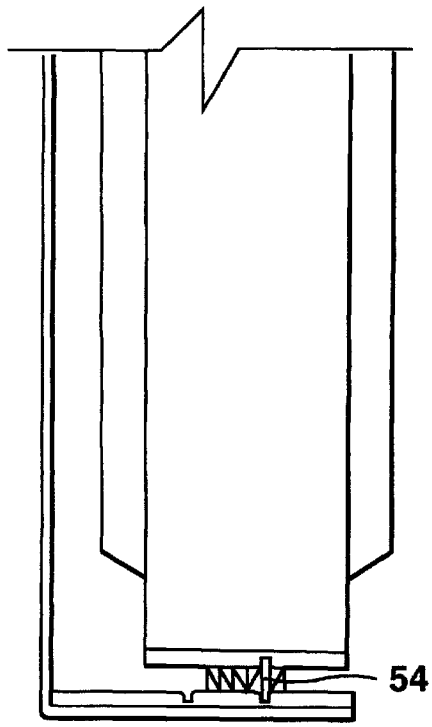
FIG. 6*b* is an enlarged cross-sectional view of the pivoting means of the invention in the second displaced position.

As discussed earlier, the preferred embodiment of the invention presents a second pair of pivoting channels 42 to receive the evaporation pad 44 in the supply air duct mounting, as shown in FIGS. 5*a*, 5*b*. The preferred embodiment disclosed herein is easily installed for use by mounting the furnace humidifier on a supply air duct by simply selecting "SUPPLY" using selecting switch 62 whereby a circuit is closed by switching means 60 when contact arm 61 is not engaged, and placing said pivoting ridges 54 in said second pair of pivoting channels 42. Now referring to FIG. 5*a*, evaporation pad 44 is shown in operation as mounted to the supply duct of a furnace, said evaporation pad being in the first resting position.

Now referring to FIG. 5*b*, evaporation pad 44 is also shown in operation as mounted to the supply air duct of a furnace, but now in a second displaced position. When the furnace is in operation and air is being forced out through the supply air duct, the pressure is greater inside the supply air duct than outside. Consequently, air flows from the supply air duct through casing 20 out of first side opening 26, thereby forcing evaporation pad 44 away from duct aperture 32. Pivoting ridges 54 pivot within said second pair of pivoting channels 42 as a result thereby pivoting said evaporation pad 44 to said second displaced position. Also as shown in FIG. 5*b*, said evaporation pad 44 disengages said contact arm 61 thereby engaging said water valve 50. Said water valve 50 thereby opens the flow of water to evaporation pad 44 consequently bringing the furnace humidifier into operation.

When the furnace is deactivated, and thereby the flow of air is reduced in said supply air duct, the pressure within the return duct returns to normal and gravity causes the evaporation pad to pivot back to the first resting position, as shown in FIG. 5*a*. Contact with contact arm 61 thereby renews, thus deactivating water valve 50 and consequently closing the water flow to the evaporation pad. The furnace humidifier is thereby shut off. Accordingly, pivoting channels, 40,42, pivoting ridges 54 and contact arm 1 provide a pivoting means responsive to air flow so as to pivot the humidifier of the present invention, thereby activating said humidifier.

It should be understood that the force required to pivot the evaporation pad 44 from the second displaced position to the first resting position must not be greater than the force which is supplied by the air flow travelling within casing 20. For this reason, the preferred embodiment of the invention disclosed herein provides for an angle of 2 degrees as between said back wall 30 of the casing and the wall of the evaporation pad 44 that is proximal to said back wall 30 in the case of both the return air duct and supply air duct mounting, as shown in FIGS. 4*a* and 4*b*, however other angles could be used also. Employing the preferred embodiment disclosed herein operation of the furnace humidifier was achieved even in air flows of approximately 50 cubic feet per minute, whereas the standard air flow of a forced air furnace is approximately 1300 cubic feet per minute.

In addition, it is necessary to provide for some means for preventing the evaporation pad 44 from pivoting beyond the second displaced position. This is particularly so in the supply duct mounting where the contact arm 61 does not act as such a stopping means. In the preferred embodiment of the invention provided for herein this stopping means is provided by water spout 59 which by means of tubing connected to evaporating pad 44 prevents the evaporating pad 44 from pivoting beyond the desired second displaced position, particularly in the supply duct mounting. This stopping means could be further provided, however, by providing the evaporation pad 44 with a stabilizing shoulder 43 adjacent to said pivoting ridges 54 or foam pad 41.

For preferred embodiments of the invention disclosed herein a switching means 60 having an operating force of 13 grams has been selected.

While modifications well-known to those skilled in the art to the furnace humidifier disclosed herein may be necessary to achieve the benefits of this invention with respect to evaporation pads of unusual size or weight, or furnaces generating unusual application force, it has been found that the using the pivoting channels, pivoting ridges, switching means, standard evaporation pads and standard forced air furnaces as described herein, the furnace humidifier operated consistently.

In a second preferred embodiment of the invention disclosed herein, a humidistat is electrically connected to the control system described herein in a manner well-known to those skilled in the art, whereby water valve 50 is only activated if contact arm 61 is engaged and the humidity is below a predetermined level.

It may be desirable to furnish the invention described herein with a signal light to indicate whether the furnace humidifier is in operation or not. Such a signal light may be easily connected with the control system described herein to signal, for example, that the valve is activated, in a manner well-known to those skilled in the art.

The casing 20 is easily produced from moulded plastic, but may also be produced out of sheet metal.

While a control system for a furnace humidifier has been described wherein the electric components are arranged above the evaporation pad, alternate arrangements can be easily adapted to the invention described herein wherein the control system is disposed below or at the side of the evaporation pad are also possible without departing from the scope of the invention. Furthermore, alternate means for facilitating displacement of the evaporation pad within the casing as a result of air flow may be used to achieve the benefits of the present invention, for example, a swivelling platform holding the evaporation pad or a hinge connecting the casing to the evaporation pad and the like. Furthermore, various other electric components may be used to sense displacement of the evaporation pad within the casing or to activate the valve. In addition, while the preferred embodiment of the invention disclosed herein describes a flow-through humidifier the means disclosed herein for activating and deactivating the humidifier using air flow could be easily adapted for use in operation with a drum or disk furnace humidifier using, for example, a displaceable drum or disk axis. Still further, while the preferred embodiment described herein employs a water flow as a water source, the invention described herein could also be adapted for use in operation with a water reservoir.

It should also be noted that the preferred embodiments described herein utilize a by-pass mounting, i.e. the furnace humidifier is mounted on either of a supply air duct or return air duct, and then the casing is connected to the other air duct to use the resultant air flow from the high pressure supply air duct to the low pressure return duct to pivot the evaporation pad. However, alternate means of mounting the furnace humidifier described herein are also possible. For example, the furnace humidifier could be mounted on the supply air duct only by cutting two holes in this air duct and erecting an air barrier between the two, mounting the furnace humidifier on one hole and connecting the casing to the other.

The invention described herein can include the humidifier in the original equipment manufactured with the furnace, or can consist of a retrofit kit.

Various embodiments of the invention have now been described in detail. Since changes in and/or additions to the above-described best mode may be made without departing from the nature, spirit or scope of the invention, the invention is not to be limited to said details.

We claim:

1. An air flow activated humidifier for use in a ventilation system wherein said humidifier is operably connected to said ventilation system and comprises a pivoting means responsive to air flow in said ventilation system so as to pivot said humidifier, thereby activating said humidifier.

2. An air flow activated humidifier for use in a ventilation system comprising a water evaporating means; displacing means engageable by the air flow of said ventilation system for displacing said water evaporating means; and activating means operably associated with said displacing means for activating said humidifier when said water evaporating means is displaced.

3. An air flow activated humidifier as claimed in claim 2 wherein said displacing means is pivotally displaceable.

4. A humidifier for use in a ventilation system comprising:

(a) a casing associated with at least one air duct of said ventilation system;

(b) a water evaporating means associated with a water source;

(c) a displacing means for mounting said water evaporating means within said casing whereby air flow of said air duct displaces said water evaporating means from a first resting position to a second displaced position; and (d) an activating means operably associated with said displacing means for activating said water evaporating means when said water evaporating means is in said second displaced position.

5. A humidifier for use in a ventilation system as claimed in claim 4, wherein said water evaporating means comprises a porous evaporation pad.

6. A humidifier for use in a ventilation system as claimed in claim 5, wherein said casing includes a bottom wall, and said porous evaporation pad includes a bottom end, and wherein said displacing means comprises:

(a) at least one channel presented by said bottom wall; and (b) said bottom end of said porous evaporation pad presents at least one pivoting ridge;

and wherein said channel and pivoting ridge are operably associated for pivoting said porous evaporation pad from said first resting position to said second displaced position.

7. A humidifier for use in a ventilation system as claimed in claim 6, wherein said bottom end of said porous evaporation pad further presents means for stabilizing said porous evaporation pad when said porous evaporation pad is in said first resting position.

8. A humidifier for use in a ventilation system as claimed in claim 7, wherein said means for stabilizing said porous evaporation pad comprises a stabilizing member adjacent to said pivoting ridge and distal of said second position.

9. A humidifier for use in association with a forced air furnace having a supply duct and return duct, each of said supply duct and return duct having a duct opening comprising:

(a) a casing having:

(i) a first opening for communicating with one of said supply duct or return duct; and (ii) a second opening for communicating with said other one of said supply duct or return duct;

(b) a connecting means for connecting said first opening to said duct opening and said second opening to said duct opening to establish said communication between said casing, supply duct and return duct;

(c) a water evaporating means associated with a water source;

(d) a means to regulate flow of water from said water source to said water evaporating means;

(e) a switching means for activating said regulating means;

(f) a displacing means for mounting said water evaporating means within said casing whereby air flow within said ducts displaces said water evaporating means from a first resting position to a second displaced position; and (g) a means for returning said water evaporating means from said second displaced position to said first resting position upon reduction of said air flow in said supply ducts;

wherein said displacing means and switching means are operably associated to engage said humidifier by activating said regulating means when said forced air furnace generates said air flow.

10. A furnace humidifier as claimed in claim 9, wherein said water evaporating means comprises a porous evaporation pad.

11. A furnace humidifier as claimed in claim 10, wherein said casing includes a bottom wall, and said porous evaporation pad includes a bottom end, and wherein said displacing means comprises:

(a) at least one channel presented by said bottom wall; and (b) said bottom end of said porous evaporation pad presents at least one pivoting ridge;

and wherein said channel and pivoting ridge are operably associated for pivoting said porous evaporation pad from said first resting position to said second displaced position.

12. A furnace humidifier as claimed in claim 11, wherein said porous evaporation pad is biased in said first resting position, and displaceable to said second displaced position.

13. A furnace humidifier as claimed in claims 12, further including means for stabilizing said porous evaporation pad in said first biased position, said stabilizing means comprising a stabilizing shoulder adjacent to said pivoting ridge and distal of said second displaced position.

14. A furnace humidifier as claimed in claim 9, wherein said switching means is further operably associated with a humidistat for engaging said water regulating means when said porous evaporation pad is in said second displaced position and the air humidity is below a predetermined level.

15. A control system for a flow-through humidifier associated with the supply and return air ducts of a forced air furnace, said flow-through humidifier comprising a casing and porous evaporation pad mounted within said casing, said porous evaporation pad being associated with a water source, wherein said casing can be mounted on either of said supply or return air ducts, said control system comprising:

(a) a pivoting means for pivoting said porous evaporation pad from a first resting position to a second displaced position upon air flow in said ducts on which said casing is mounted;

(b) a means for returning said porous evaporation pad from said second displaced position to said first resting position when there is no air flow in said ducts;

(c) a switching means connected to a power source and operably associated with said pivoting means when said porous evaporation pad is in said second displaced position; and (d) a water valve engageable by said switching means to regulate flow of water from said water source to said porous evaporation pad.

16. A control system as claimed in claim 15, wherein said switching means is further operably associated with a humidistat for engaging said valve where said porous evaporation pad is in said second displaced position and the air humidity in said casing is below a predetermined level.

17. A control system as claimed in claim 15, wherein said casing includes a bottom wall, and said porous evaporation pad includes a bottom end, and wherein said displacing means comprises:

(a) at least one channel presented by said bottom wall; and (b) said bottom end of said porous evaporation pad presents at least one pivoting ridge;

and wherein said channel and pivoting ridge are operably associated for pivoting said porous evaporation pad from said first resting position to said second displaced position.

18. A control system as claimed in claim 17, wherein said porous evaporation pad is biased in said first resting position, and displaceable to said second displaced position.

19. A control system as claimed in claim 18, further including means for stabilizing said porous evaporation pad in said first biased position, said stabilizing means comprising a stabilizing shoulder adjacent to said pivoting ridge and distal of said second displaced position.

20. A method for humidifying air circulated by a forced air furnace, said furnace having a supply duct and return duct, comprising the steps of:

(a) creating openings on said supply duct and return duct;

(b) mounting on either of said supply duct or return duct a casing having a first opening for communicating with said supply duct and second opening for communicating with said return duct; said casing further including:

(i) a water evaporating means associated with a water source;

(ii) a means to regulate flow of water from said water source to said water evaporating means;

(iii) a switching means for activating said regulating means;

(iv) a displacing means for mounting said water evaporating means within said casing whereby air flow within said ducts displaces said water evaporating means from a first resting position to a second displaced position; and (v) a means for returning said water evaporating means from said second displaced position to said first resting position upon reduction of said air flow in said supply ducts;

(b) connecting said first opening to said supply duct and said second opening to said return duct to establish communication between said casing, supply duct and return duct;

(c) mounting a flow-through evaporation pad within said casing, said displacing means being engageable by air flow present in either of said supply duct or return duct on which said casing is mounted to displace said flow-through evaporation pad from a first resting position to a second displaced position; and (d) connecting said casing to a power source whereby said valve is activated when said flow-through evaporation pad is in said second displaced position and said switching means is thereby engaged.

21. The method as claimed in claim 20, consisting of the further step of connecting said switching means to a humidistat whereby said valve is engaged when said flow-through evaporation pad is in said second displaced position and the air humidity in said casing is below a predetermined level.

22. A method for humidifying air in a ventilation system comprising the steps of:

(a) creating openings on at least one air duct presented by said ventilation system;

(b) mounting an air flow activated humidifier on said at least one air duct whereby said humidifier is operably connected to said ventilation system, and said humidifier comprises a pivoting means responsive to air flow in said ventilation system so as to pivot said humidifier, thereby activating said humidifier; and (c) connecting said humidifier with a water source.

* * * * *